US009752842B1

(12) United States Patent
Huang

(10) Patent No.: US 9,752,842 B1
(45) Date of Patent: Sep. 5, 2017

(54) ARCHERY BOW WITH A CAM TIMING BELT

(71) Applicant: Dorge O. Huang, Henry, IL (US)

(72) Inventor: Dorge O. Huang, Henry, IL (US)

( * ) Notice: Subject to any disclaimer, the term of this patent is extended or adjusted under 35 U.S.C. 154(b) by 0 days.

(21) Appl. No.: 15/428,215

(22) Filed: Feb. 9, 2017

(51) Int. Cl.
*F41B 5/10* (2006.01)
*F41B 5/14* (2006.01)

(52) U.S. Cl.
CPC ..... *F41B 5/105* (2013.01); *F41B 5/10* (2013.01); *F41B 5/1403* (2013.01)

(58) Field of Classification Search
CPC ..... F41B 5/10
See application file for complete search history.

(56) References Cited

U.S. PATENT DOCUMENTS 4,064,862 A * 12/1977 Groner ..... F41B 5/10 124/25.6
5,535,727 A * 7/1996 Helmuth ..... F41B 5/10 124/25.6
5,967,132 A * 10/1999 Loomis ..... F41B 5/10 124/25.6
7,047,958 B1 * 5/2006 Colley ..... F41B 5/105 124/25.6
8,387,603 B2 * 3/2013 Darlington ..... F41B 5/10 124/23.1
9,255,753 B2 2/2016 Pulkrabek et al.

* cited by examiner

*Primary Examiner* — John Ricci
(74) *Attorney, Agent, or Firm* — Donald J. Ersler

(57) ABSTRACT

An archery bow with a cam timing belt preferably includes a first cam pulley, a first cam cable, a first timing pulley, a second cam pulley, a second cam cable, a second timing pulley and a timing belt. An archery bow includes a riser, a first limb, a second limb, a first cam and a second cam. The riser preferably includes a first timing projection and a second timing projection. The first cam pulley and the first timing pulley are rotatably retained on the first timing projection. The first cable is preferably secured to a first cam axle and the first cam. The second cam pulley and the second timing pulley are rotatably retained on the second timing projection. The second cable is preferably secured to a second cam axle and the second cam. The timing belt is secured to the first and second timing pulleys.

8 Claims, 3 Drawing Sheets

ARCHERY BOW WITH A CAM TIMING BELT

BACKGROUND OF THE INVENTION

1. Field of the Invention

The present invention relates generally to archery and more specifically to an archery bow with a cam timing belt, which ensures that opposing cams are paying-out equal lengths of a bowstring.

2. Discussion of the Prior Art

It appears that the prior art does not teach or suggest an archery bow with a cam timing belt, which utilizes a timing belt to sync opposing cams to each other. U.S. Pat. No. 9,255,753 to Pulkrabek et al. discloses an energy storage device for a bow. The timing belt is used to sync opposing translation arms to each other. However, it is very easy to induce an unequal payout of a bowstring from cams of a vertical archery bow. A binary cam set-up will help sync payout of bowstring from the first and second cams. However, a bowstring can still have unequal payout in a binary cam system, when the vertical archery bow is not rigidly held by an archer.

Accordingly, there is a clearly felt need in the art for an archery bow with a cam timing belt, which ensures that opposing cams are paying-out equal lengths of a bowstring, and which ensures that crossing cam cables are not interfering with a hand and arm holding the archery bow.

SUMMARY OF THE INVENTION

The present invention provides an archery bow with a cam timing belt, which ensures that crossing cables are not interfering with a hand holding the archery bow. The archery bow with a cam timing belt (cam timing system) preferably includes a first cam pulley, a first cam cable, a first timing pulley, a second cam pulley, a second cam cable, a second timing pulley and a timing belt. An archery bow includes a riser, a first limb, a second limb, a first cam and a second cam. One end of the first limb is attached to a first end of the riser and the first cam is rotatably retained on an opposing end of the first limb. One end of a second limb is attached to a second end of the riser and the second cam is rotatably retained on an opposing end of the second limb. A first end of a bowstring is retained on the first cam and a second end of the bowstring is retained on the second cam. The riser preferably includes a first timing projection and a second timing projection. The first timing projection extends outward from the riser near the first limb. The second timing projection extends outward from the riser near the second limb.

A first axle is rotatably retained in an end of the first timing projection and a second axle is rotatably retained in an end of the second timing projection. The first cam pulley is secured to one end of the first axle substantially in-line with the first cam of the archery bow. One end of the first cable is preferably secured to a first cam axle and an opposing end of the first cable is secured to the first cam. The first timing pulley is secured to an opposing end of the first axle. The second cam pulley is secured to one end of the second axle substantially in-line with the second cam of the archery bow. One end of the second cable is preferably secured to a second cam axle and an opposing end of the second cable is secured to the second cam. The second timing pulley is secured to an opposing end of the second axle. The timing belt is secured to the first and second timing pulleys in a twisted orientation. When the bowstring is pulled back, the timing belt forces equal payouts of bowstring occur from the first and second cams. The timing belt is also horizontally offset from the riser to provide clearance for the arm and hand of an archer.

Accordingly, it is an object of the present invention to provide a cam timing system, which ensures that opposing cams are paying-out equal lengths of a bowstring Finally, it is another object of the present invention to provide a cam timing system, which ensures that crossing cables are not interfering with an arm and hand of archer holding the archery bow.

These and additional objects, advantages, features and benefits of the present invention will become apparent from the following specification.

DETAILED DESCRIPTION OF THE PREFERRED EMBODIMENTS

Figure 1:
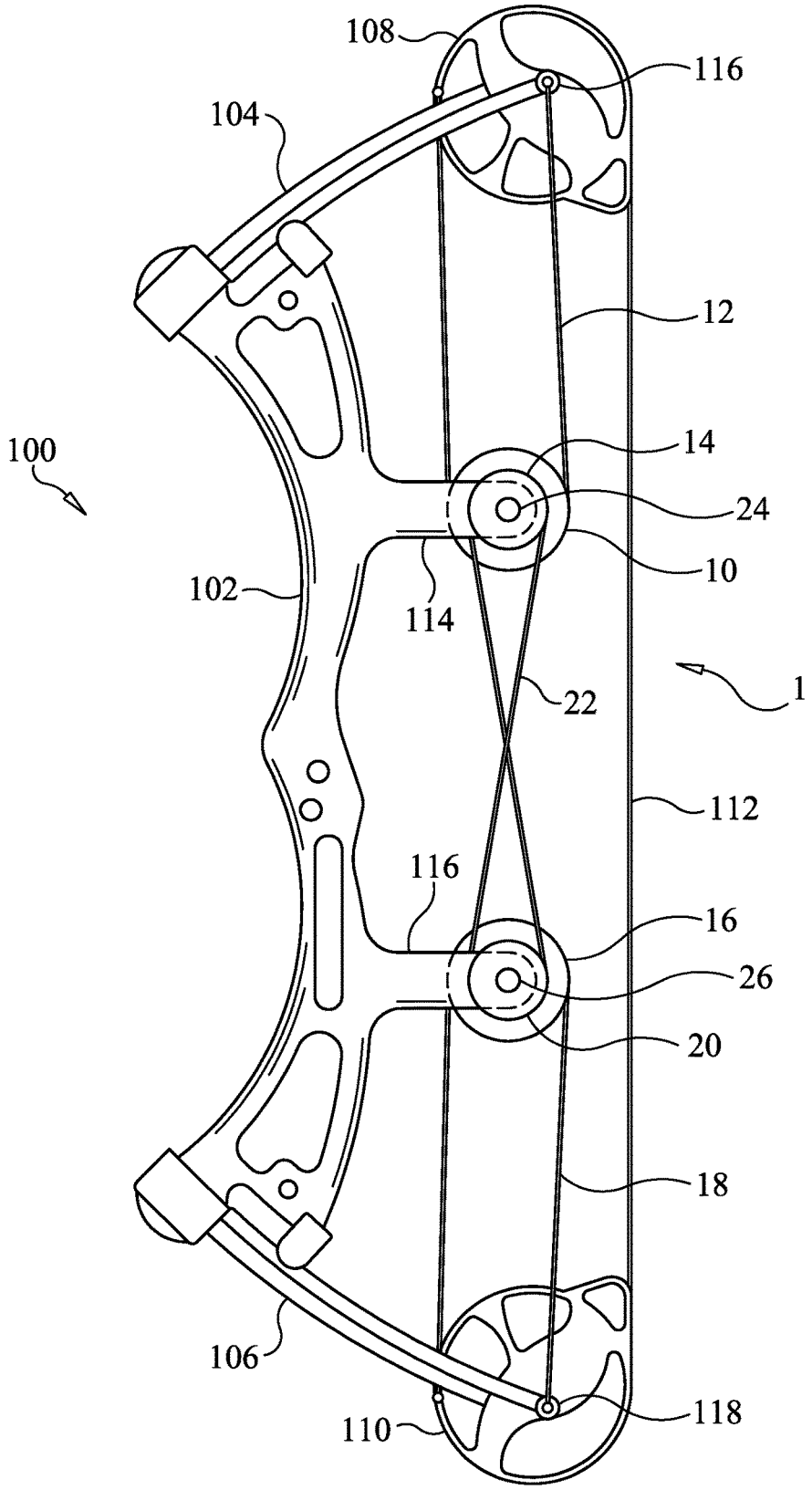
FIG. 1 is a side view of a cam timing system installed on a vertical archery bow in accordance with the present invention.
Figure 2:
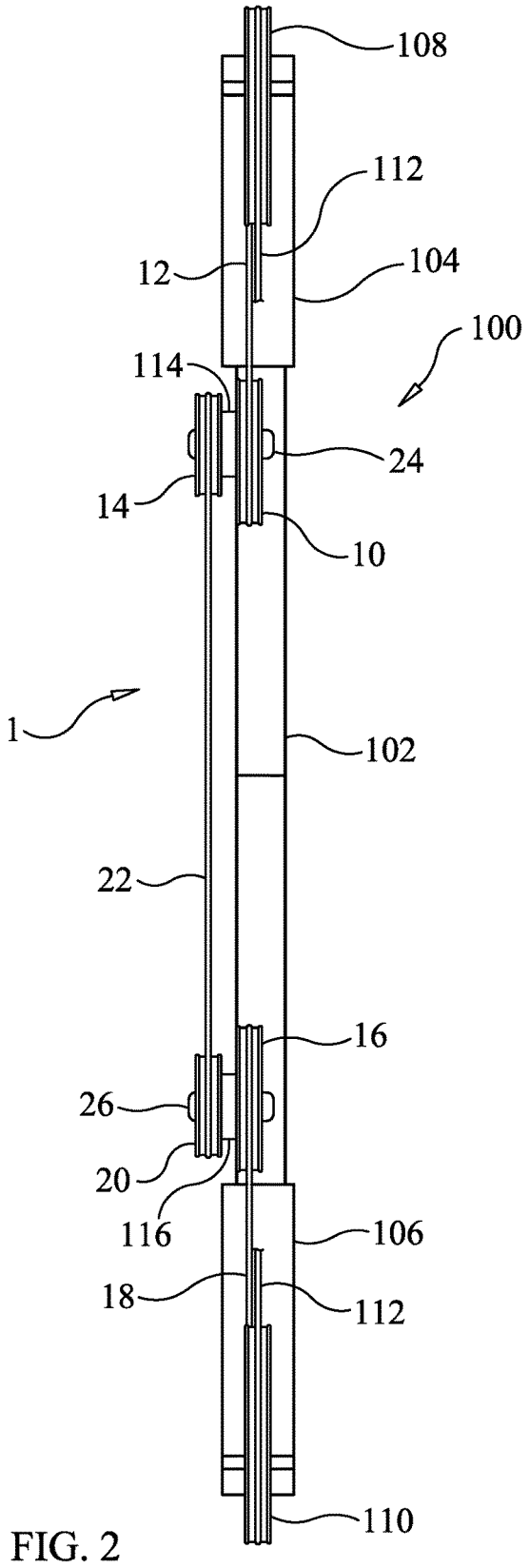
FIG. 2 is a front view of a cam timing system installed on a vertical archery bow in accordance with the present invention.

With reference now to the drawings, and particularly to FIG. 1, there is shown a side view of a cam timing system 1. With reference to FIG. 2, the cam timing system 1 preferably includes a first cam pulley 10, a first cam cable 12, a first timing pulley 14, a second cam pulley 16, a second cam cable 18, a second timing pulley 20 and a timing belt 22. An archery bow 100 includes a riser 102, a first limb 104, a second limb 106, a first cam 108 and a second cam 110. One end of the first limb 104 is attached to a first end of the riser 102 and the first cam 108 is rotatably retained on an opposing end of the first limb 104. One end of a second limb 106 is attached to a second end of the riser 102 and the second cam 110 is rotatably retained on an opposing end of the second limb 106. A first end of a bowstring 112 is retained on the first cam 108 and a second end of the bowstring 112 is retained on the second cam 110. The riser 102 includes a first timing projection 114 and a second timing projection 116. The first timing projection 114 extends outward from the riser 102, near the first limb 104. The second timing projection extends outward from the riser 102, near the second limb 106.

Figure 3:
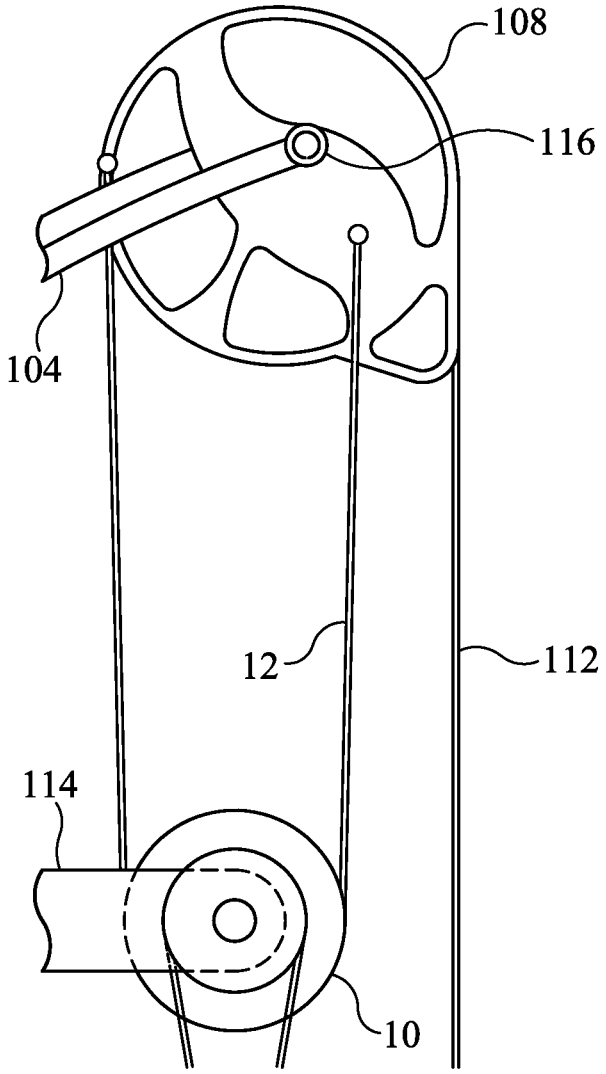
FIG. 3 is an enlarged partial side view of a first cable having each end attached to a first cam of a vertical archery bow of a cam timing system in accordance with the present invention.

A first axle 24 is rotatably retained in an end of the first timing projection 114 and a second axle 26 is rotatably retained in an end of the second timing projection 116. The first cam pulley 10 is secured to one end of the first axle 24 substantially in-line with the first cam 108. One end of the first cable 12 is preferably secured to a first cam axle 116 with any suitable device and an opposing end of the first cable 12 is secured to the first cam 108. However, with reference to FIG. 3, the opposing end of the first cable 12 may be secured to the first cam 108 instead of the first cam axle 116. The first timing pulley 14 is secured to an opposing end of the first axle 24. The second cam pulley 16 is secured to one end of the second axle 26 substantially in-line with the second cam 110. One end of the second cable 18 is preferably secured to a second cam axle 26 with any suitable device and an opposing end of the second cable 18 is secured to the second cam 110. However, the opposing end of the second cable 18 may be secured to the second limb 106 or to the second cam 110 instead of the second cam axle 118. The second timing pulley 20 is secured to an opposing end of the second axle 26.

The timing belt 22 is secured to the first and second timing pulleys 14, 20. The timing belt 22 is twisted to ensure that the first and second timing pulleys 14, 20 rotate in opposite directions. For example, the first timing pulley 14 could rotate clockwise and the second timing pulley 20 would rotate counterclockwise. When the bowstring 112 is pulled back, the timing belt forces the first and second cams 108, 110 to rotate in sync with each other with the result of equal payouts of the bowstring 112 from the first and second pulleys 108, 110. The timing belt 22 is also offset from the riser 102 to provide clearance for the arm and hand of an archer.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A cam timing system for an archery bow, the archery bow includes a riser, a first limb extending from a first end of the riser, a second limb extending from a second end of the riser, a first cam rotatably retained on the first limb, a second cam rotatably retained on the second limb, comprising:

a first cam pulley is capable of being rotated relative to the riser;

a first cam cable is capable of having one end attached to the first cam, an opposing end of said first cam cable is attached to one of the first cam and a first cam axle, said first cam cable contacts said first cam pulley;

a first timing pulley includes a drive connection with said first cam pulley;

a second cam pulley is capable of being rotated relative to the riser;

a second cam cable is capable of having one end attached to the second cam, an opposing end of said second cam cable is attached to one of the second cam and a second cam axle, said second cam cable contacts said second cam pulley;

a second timing pulley includes a drive connection with said second cam pulley; and a timing belt is retained on said first and second timing pulleys, said timing belt is twisted to ensure that said first and second timing pulleys rotate in opposite directions.

2. The cam timing system for an archery bow of claim 1 wherein:

the riser includes a first timing projection and a second timing projection, the first timing projection extends from the riser near the first limb, the second timing projection extends from the riser near the second limb, said first cam pulley is capable of being rotatably retained on an end of the first timing projection, said second cam pulley is capable of being rotatably retained on an end of the second timing projection.

3. The cam timing system for an archery bow of claim 1, further comprising:

a bowstring having a first end retained on the first cam and a second end retained on the second cam.

4. The cam timing system for an archery bow of claim 1 wherein:

said timing belt is horizontally offset from said riser to provide clearance for an arm or hand of an archer.

5. An archery bow having a cam timing belt comprising:

an archery bow includes a riser, a first limb, a second limb, a first cam, a second cam, said first limb extends from a first end of said riser, said second limb extends from a second end of said riser, said first cam is rotatably retained on said first limb, said second cam is rotatably retained on said second limb;

a first cam pulley is rotatably retained relative to said riser;

a first cam cable having one end attached to said first cam, an opposing end of said first cam cable is attached to one of said first cam and a first cam axle, said first cam cable contacts said first cam pulley;

a first timing pulley includes a first drive connection with said first cam pulley;

a second cam pulley is rotatably retained relative to said riser;

a second cam cable having one end attached to the second cam, an opposing end of said second cam cable is attached to one of the second cam and a second cam axle, said second cam cable contacts said second cam pulley;

a second timing pulley includes a second drive connection with said second cam pulley; and said timing belt is retained on said first and second timing pulleys.

6. The cam timing system for an archery bow of claim 5 wherein:

said riser includes a first timing projection and a second timing projection, said first timing projection extends from said riser near said first limb, said second timing projection extends from said riser near said second limb, said first cam pulley is rotatably retained on an end of said first timing projection, said second cam pulley is rotatably retained on an end of said second timing projection.

7. The cam timing system for an archery bow of claim 5, further comprising:

a bowstring having a first end retained on the first cam and a second end retained on the second cam.

8. The cam timing system for an archery bow of claim 7 wherein:

said timing belt is horizontally offset from said riser to provide clearance for an arm or hand of an archer.

* * * * *